United States Patent [19]

Milner

[11] 4,139,968

[45] Feb. 20, 1979

[54] PUPPET-LIKE APPARATUS

[75] Inventor: Ronald E. Milner, Grass Valley, Calif.

[73] Assignee: Atari, Inc., Sunnyvale, Calif.

[21] Appl. No.: 792,995

[22] Filed: May 2, 1977

[51] Int. Cl.[2] ..... A63H 13/00

[52] U.S. Cl. ..... 46/264

[58] Field of Search ..... 46/232, 264

[56] References Cited

U.S. PATENT DOCUMENTS

| | | | |
|---|---|---|---|
| 2,270,142 | 1/1942 | Robinson et al. | 46/232 |
| 3,828,469 | 8/1974 | Giroud | 46/264 |

*Primary Examiner*—Russell R. Kinsey
*Assistant Examiner*—Robert F. Cutting
*Attorney, Agent, or Firm*—Townsend and Townsend

[57] ABSTRACT

Puppet-like apparatus includes a manikin head having a face with a hinged jaw. A drive motor is connected to the jaw to reciprocate it. Within the head are a radio receiver having a level detector which responds to the audio peaks to actuate the drive motor in forward and reverse directions to open and close the jaw thereby simulating speech. In addition, an exterior microphone is provided for speech input.

6 Claims, 1 Drawing Figure

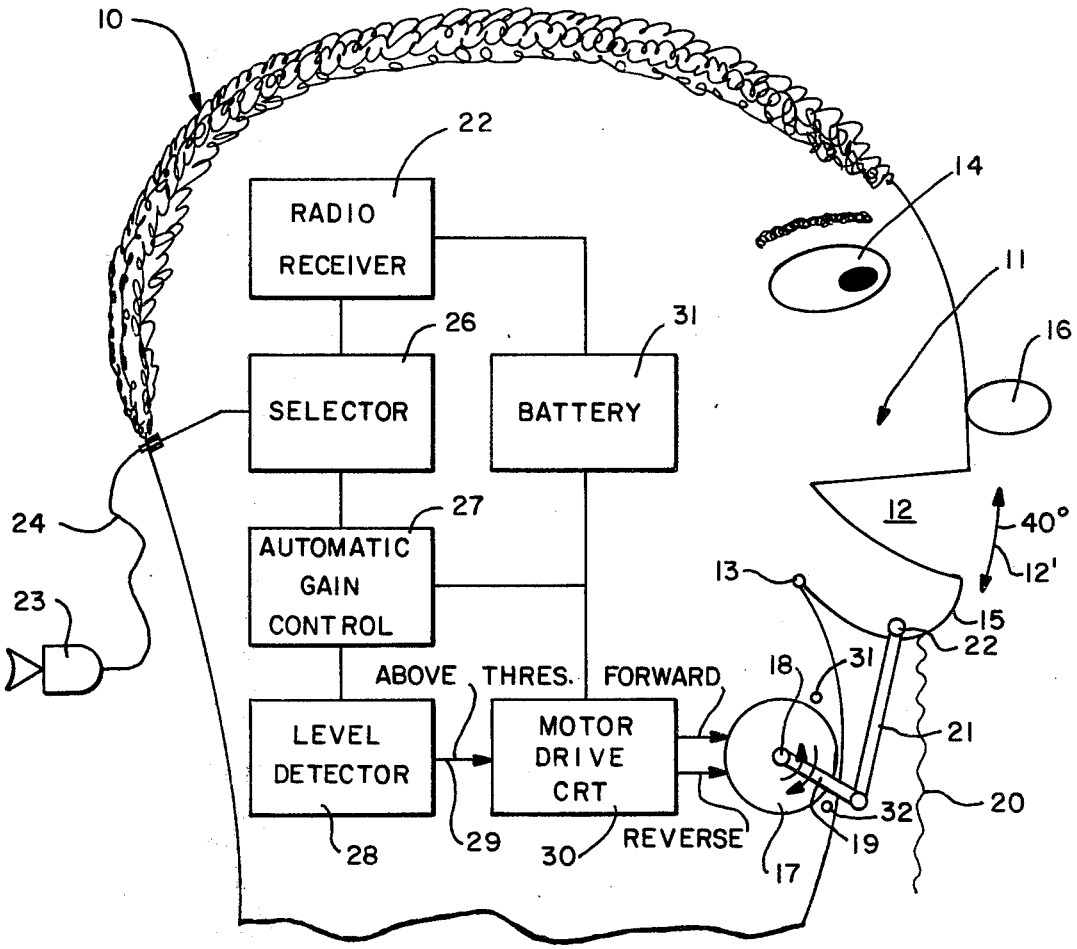
10
22
RADIO RECEIVER
14
11
26
31
16
SELECTOR
BATTERY
24
27
12
40°
AUTOMATIC GAIN CONTROL
12'
13
23
15
22
ABOVE
THRES.
FORWARD
18
31
LEVEL DETECTOR
MOTOR DRIVE CRT
21
20
32
19
28
29
30
REVERSE
17

PUPPET-LIKE APPARATUS

BACKGROUND OF THE INVENTION

The present invention is directed to puppet-like apparatus and more specifically to a puppet-like head which provides plausible mouth movements simulating speech in response to an audio sound source.

Very effective techniques have been used in the past to provide for puppet-like heads simulating speech. For example, in theme amusement parks mouth movements are preprogrammed by a separate circuit to conform to the audio source. The mouth movements themselves are implemented with air cylinders and high cost hardware. From a more elementary standpoint talking dolls are effectively preprogrammed also for relatively simple one or two cycle mouth movements.

Thus there is a need for a puppet-like toy which provides a plausible simulation of mouth movements in conjunction with an audio sound source but yet at a fairly reasonable cost. Moreover, there is a need for a toy-like device as described above where a child can actually be an essential part of the simulated talking process.

OBJECTS AND SUMMARY OF THE INVENTION

It is therefore an object of the invention to provide an improved puppet-like apparatus.

It is a more specific object of the invention to provide apparatus as above which has a puppet style head whose mouth follows an audio sound source pattern with the use of relatively inexpensive hardware.

In accordance with the above objects there is provided puppet-like apparatus which comprises a manikin head having a face with a movable mouth. Electric drive means move the mouth. An audio source is provided. Means are responsive to an intermittent characteristic of the sound source for activating the electric drive means.

BRIEF DESCRIPTION OF THE DRAWINGS

The single drawing shows a side view of a manikin type head partially cut away to show a block circuit diagram of apparatus embodying the present invention.

DETAILED DESCRIPTION OF THE PREFERRED EMBODIMENT

The single drawing shows a manikin head 10 having a face 11 with a movable mouth 12 as indicated by the double-ended arrows 12'. Mouth 12 has a jaw 15 which is effectively hinged at point 13 for reciprocating movement. It is obvious that many variations of the mouth could be made and especially of the jaw 15 so that instead of a hinge 13 merely an area of greater flexure is provided. Face 11 also includes eyes 14 and a nose 16.

The jaw portion 15 of the overall mouth is reciprocated as shown by the arrow 12' by a reversible dc electric drive motor 17 having an output shaft 18. On the shaft is mounted a crank 19 which at its other end carries lever 21 which is connected at point 22 to the jaw 15. A skirt 20 hanging from jaw 15 hides the levers.

Two alternate or concurrent audio sound sources are provided. First there is a radio receiver 22 contained within head 10 and secondly an external microphone 23 through which the user may speak and which is connected into the head through flexible cord 24. A selector unit 26 receives the outputs of both radio receiver 22 and microphone 23 to either concurrently utilize the audio information for driving the mouth 12 or selectively as desired.

The output of selector unit 26 is fed into an automatic gain control (AGC) unit which averages out the volume levels to compensate for adjustments in the actual loudness of the radio receiver or microphone. A level detector 28 is responsive to an intermittent characteristic of the sound source which in this particular case is the volume level and whenever the volume level exceeds a predetermined threshold level as determined by detector 28 an output signal occurs on line 29 to a motor drive circuit 30. Drive circuit 30 causes motor shaft 18 to rotate in the forward direction, as indicated, while an above threshold signal is being received on line 29 to thereby open jaw 15. In the absence of a threshold signal shaft 18 is rotated in a reverse direction to place jaw 15 in a normally closed position. Rotation of shaft 18 is limited to a fraction of a revolution by stops 31 and 32 which interfere with crank 18. The location of the stops in combination with the lengths of crank 19 and lever 21 are adjusted to provide a 40° range of movement, 12', for jaw 15.

Drive circuit 30 includes a reversing transistor bridge with one side to positive battery and the other to ground which is switched by input 29.

Motor 17 is similar to those used in may toys where output shaft 18 is geared down from the speed of the rotor of the motor.

An alternate desirable technique to conserve motor power is to drive the motor only for a time sufficient to turn the jaw to the stop (in either direction) and then remove power rather than powering the motor against the stops.

It is believed that the foregoing threshold level technique in combination with the reversible motor provides a plausible mouth movement representing speech and in a very simple and economical manner. For example, theoretically a solenoid could replace the motor but this action might be too quick to be realistic.

An internal battery 31 may be utilized to power the associated circuitry. The radio receiver and the remainder of the associated circuitry is self-contained within the head.

Thus an improved puppet-like apparatus has been provided.

What is claimed is:

1. Puppet-like apparatus comprising a manikin head having a face with a movable mouth having an effectively hinged jaw; electric drive means for moving said mouth including a motor with a drive shaft, a crank connected to said shaft and a lever connecting said crank to said hinged jaw said motor being reversible, opening said jaw in the forward direction and closing said jaw in the reverse direction and including means for limiting rotation of said drive shaft to a fraction of a revolution; an audio sound source; and means responsive to an intermittent characteristic of said sound source for activating said electric drive means.

2. Apparatus as in claim 1 where said intermittent characteristic is volume level.

3. Apparatus as in claim 2 together with threshold means responsive to said volume level for activating said electric drive means.

4. Apparatus as in claim 1 together with automatic gain control means for controlling the average level of said audio sound source.

5. Apparatus as in claim 1 where said audio sound source is self-contained in said manikin head.

6. Apparatus as in claim 3 where said electric drive means normally maintains said mouth in a closed position and is responsive to said volume level exceeding said threshold level for opening said mouth.

* * * * *